United States Patent [19]

Goudriaan et al.

[11] 4,062,758

[45] Dec. 13, 1977

[54] PROCESS FOR THE CONVERSION OF HYDROCARBONS IN ATMOSPHERIC CRUDE RESIDUE

[75] Inventors: Frans Goudriaan; Jakob van Klinken, both of Amsterdam, Netherlands

[73] Assignee: Shell Oil Company, Houston, Tex.

[21] Appl. No.: 717,972

[22] Filed: Aug. 26, 1976

[30] Foreign Application Priority Data

Sept. 5, 1975 Netherlands ..... 7510465

[51] Int. Cl.[2] ..... C10G 39/00; C10G 13/06

[52] U.S. Cl. ..... 208/80; 208/58; 208/78; 208/86; 208/108; 208/111; 208/210; 208/218; 208/251 H; 252/441; 252/458; 252/470

[58] Field of Search ..... 208/58, 86, 80, 78, 208/210, 218, 251 H

[56] References Cited

U.S. PATENT DOCUMENTS

| | | | |
|---|---|---|---|
| 3,175,966 | 3/1965 | Burch | 208/111 X |
| 3,380,910 | 4/1968 | Griffiths | 208/58 |
| 3,775,292 | 11/1973 | Watkins | 208/86 |
| 3,775,293 | 11/1973 | Watkins | 208/86 |

*Primary Examiner*—George Crasanakis
*Assistant Examiner*—G. E. Schmitkons
*Attorney, Agent, or Firm*—Ronald R. Reper

[57] ABSTRACT

A process is disclosed for the production of distillate hydrocarbons from atmospheric distillation hydrocarbon residue.

8 Claims, 2 Drawing Figures

PROCESS FOR THE CONVERSION OF HYDROCARBONS IN ATMOSPHERIC CRUDE RESIDUE

BACKGROUND OF THE INVENTION

The invention relates to a process for the preparation of one or more atmospheric hydrocarbon oil distillates from an atmospheric hydrocarbon oil residue.

In the atmospheric distillation of crude petroleum, as employed on a large scale in the refineries for the preparation of atmospheric hydrocarbon oil distillates, a residual oil is obtained as a by-product. In some cases this residual oil is suitable to serve as base material for the manufacture of lubricating oil, but often the residual oil, which as a rule contains considerable quantities of sulfur, metals and asphaltenes, is only eligible for use as fuel oil.

In view of the growing need for atmospheric hydrocarbon oil distillates various processes were proposed in the past which aimed at converting the residual oils into atmospheric distillates. Examples of such processes are catalytic cracking, thermal cracking, gasification in combination with hydrocarbon synthesis, coking and hydrocracking. The use of the residual oils per se as feed for each of these processes has considerable drawbacks, which seriously hamper their application on a commercial scale. Thus, for instance, hydrocracking will lead to a rapid catalyst deactivation, a high gas production, and a high consumption of hydrogen.

In view of the above and taking into account the fact that in the atmospheric distillation of crude petroleum about half of the crude oil is left behind as distillation residue, it will be clear that there is an urgent need for a process which offers the possiblity of converting, in an economically acceptable way, atmospheric hydrocarbon oil residues into atmospheric hydrocarbon oil distillates, such as gasolines.

Since in practice hydrocracking has proved to be an excellent process for the conversion of heavy hydrocarbon oil distillates such as gas oils into light hydrocarbon oil distillates such as gasolines, the applicant has carried out an investigation in order to find out to what extent hydrocracking can be used for the conversion of atmospheric hydrocarbon oil residues into atmospheric hydrocarbon oil distillates. The present invention relates to certain combinations of hydrocracking together with catalytic hydrotreatment and deasphalting resulting in a process eminently suitable for this purpose.

SUMMARY OF THE INVENTION

In the process according to the invention an atmospheric hydrocarbon oil residue is split by vacuum distillation into a vacuum distillate $VD_1$ and a vacuum residue $VR_1$. The vacuum residue or an asphalt obtained therefrom by deasphalting is subjected to a catalytic hydrotreatment and the hydrotreated product is split into one or more light atmospheric distillates as end-products, a middle distillate $M_1$ as end-product or as intermediate product and an atmospheric residue which is split further by vacuum distillation into a vacuum distillate $VD_2$ and a vacuum residue $VR_2$. The vacuum residue $VR_2$ or an asphalt obtained therefrom by deasphalting is at least partly again subjected to the catalytic hydrotreatment. The vacuum distillates $VD_1$ and $VD_2$, together with a deasphalted oil and, if desired, the atmospheric middle distillate $M_1$ are hydrocracked. The cracked product is split by atmospheric distillation into one or more light distillates as end-products, if desired a middle distillate $M_2$ as end-product and a residue of which at least part is again subjected to hydrocracking. The deasphalted oil mentioned has been obtained by deasphalting either vacuum residue $VR_1$, or vacuum residue $VR_2$.

DESCRIPTION OF THE PREFERRED EMBODIMENTS

Figure 1:
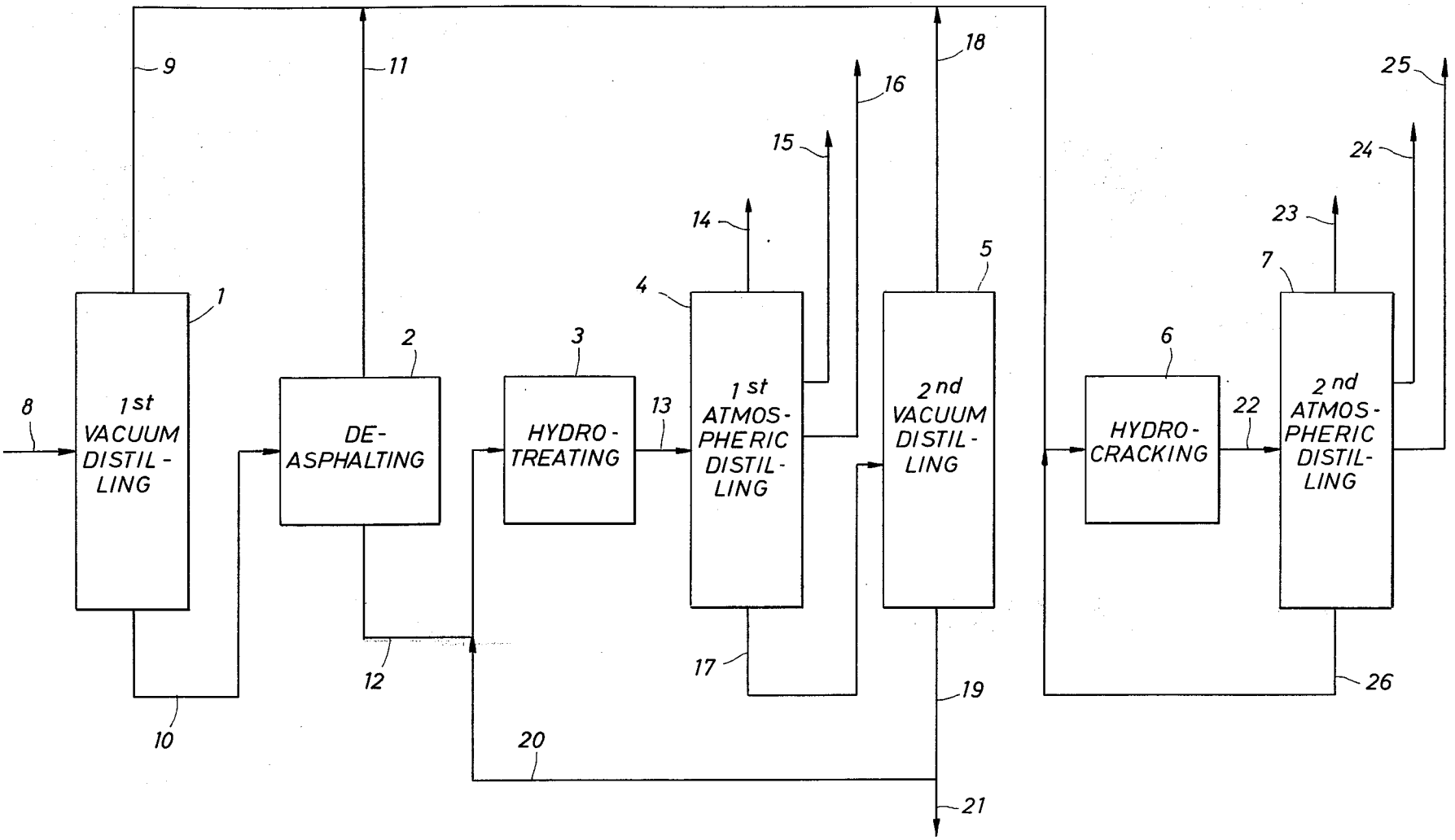
Figure 2:
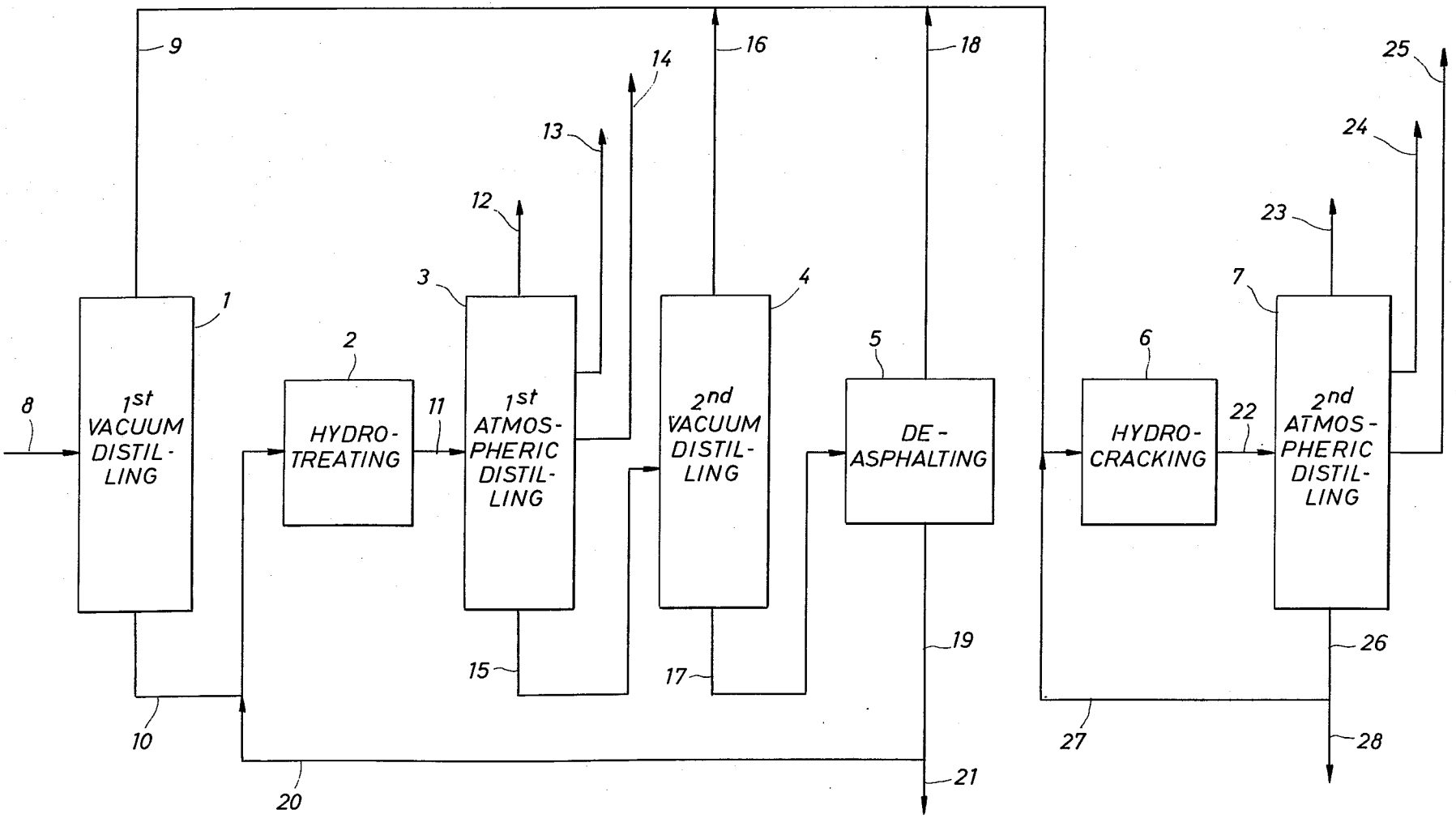

In the process according to the invention hydrocracking is employed as the main process. In the hydrocracking process a considerable part of the heavy feed is converted into lighter products. The desired end-products are separated from the cracked product by atmospheric distillation.

If it is the intention to prepare only one or more light distillates as end-products, further processing of the residue may take place in the following ways.

1. The entire residue is again subjected to hydrocracking.
2. The residue is split into two portions of the same composition and one of these portions is again subjected to hydrocracking whereas the other portion is removed from the process and may be used, for instance, as blending component for fuel oil.
3. In the atmospheric distillation of the cracked product, besides one or more light distillates, an atmospheric middle distillate $M_2$ is separated which is again subjected to hydrocracking. The residue obtained in this atmospheric distillation may be processed further in the following ways.
   a. The entire residue is removed from the process.
   b. The residue is split into two portions of the same composition and one of these portions is again subjected to hydrocracking, whereas the other portion is removed from the process.
   c. From the residue a distillate is separated by vacuum distillation, which distillate is again subjected to hydrocracking. The residue obtained by this vacuum distillation is removed from the process or is split into two portions of the same composition, of which one is again subjected to hydrocracking, whereas the other portion is removed from the process.

If it is the intention to prepare an atmospheric middle distillate $M_2$ as end-product, as well as one or more light distillates, further processing of the residue so obtained may take place in the same way as indicated hereinbefore under (1.), (2.) and (3.c).

If in the further processing of a residue obtained by distillation of the hydrocracked product use is made of a process in which the residue is divided into two portions of the same composition of which one is again subjected to hydrocracking whereas the other portion is removed from the process, the quantity of material that is recirculated is preferably more than 25%w of the available quantity of residue and this quantity is preferably chosen higher according as the residue concerned has a lower initial boiling point.

The hydrocracking used as the main treatment in the process according to the invention takes place by contacting the feed at elevated temperature and pressure and in the presence of hydrogen with a suitable hydrocracking catalyst. Preferably the hydrocracking is carried out as a two-step process, the hydrocracking proper, which takes place in the second step, being preceded by a catalytic hydrotreatment in order to reduce the nitrogen and polyaromatics content of the feed to be hydrocracked. Suitable catalysts for use in the one-step hydrocracking process as well as for use in the second step of the two-step hydrocracking process are moderately acidic and strongly acidic catalysts which contain one or more metals with hydrogenating activity on a carrier. Examples of suitable catalysts for use in the one-step hydrocracking process are fluorine-containing sulfidic catalysts comprising nickel and/or cobalt and in addition molybdenum and/or tungsten on amorphous silica-alumina as carrier, sulfidic catalysts containing or not containing fluorine, and comprising nickel and/or cobalt and in addition molybdenum and/or tungsten on crystalline silica-alumina as carrier, and catalyst, containing or not containing fluorine and comprising one or more noble metals from Group VIII and in particular palladium on crystalline silica-alumina as carrier. Suitable catalysts for use in the first step of the two-step hydrocracking processes are weakly acidic and moderately acidic catalysts comprising one or more metals with hydrogenating activity on a carrier, such as fluorine-containing sulfidic catalysts comprising nickel and/or cobalt and in addition molybdenum and/or tungsten on alumina or amorphous silica-alumina as carrier.

If in the process according to the invention the hydrocracking is carried out in one step preferably the following reaction conditions are applied: a temperature in the range from about 250° to 425° C and particularly of from 300° to 390° C, a hydrogen partial pressure in the range from about 50 to 300 bar and particularly from 75 to 150 bar, a space velocity in the range from about 0.1 to 10 $kg.\mathbf{1}^{-1}.hour^{-1}$ and particularly of from 0.25 to 2 $kg.\mathbf{1}^{-1}.hour^{-1}$ and a hydrogen/feed ratio in the range from about 200 to 3000 $\mathbf{N1}.kg^{-1}$ and particularly of from 1000 to 2000 $\mathbf{N1}.kg^{-1}$. If according to the invention the hydrocracking is carried out in two steps the following reaction conditions are preferably employed in the first step: a temperature in the range from about 300° to 450° C and particularly from 350° to 420° C, a hydrogen partial pressure in the range from about 50 to 300 bar and particularly of from 75 to 150 bar, a space velocity in the range from about 0.1–5 $kg.\mathbf{1}^{-1}.hour^{-1}$ and particularly from 0.75 to 1.5 $kg.\mathbf{1}^{-1}.hour^{-1}$ and a hydrogen/feed ratio from 200 to 3000 $\mathbf{N1}.kg^{-1}$. In the second step preferably substantially the same conditions are applied as indicated hereinbefore for the one-step process. When the hydrocracking is carried out accoridng to the two-step process preferably the whole reaction product from the first step i.e., without ammonia, hydrogen sulfide or other volatile components having been separated therefrom, is used as feed for the second step.

In the process according to the invention catalytic hydrotreatment is applied to a vacuum residue or asphalt. In this treatment compounds whose presence in the feed for a hydrocracker is not very desirable are converted into compounds more suitable for this purpose. In this treatment at the same time a small quantity of atmospheric hydrocarbon oil distillate is formed, which is isolated as end-product. The hydrotreated product is split into one or more light atmospheric distillates as end-products, an atmospheric middle distillate $M_1$ and an atmospheric residue, which is further split by vacuum distillation into a vacuum distillate $VD_2$ and a vacuum residue $VR_2$.

If it is the intention to prepare only one or more light distillates as end-products by the process according to the invention, the atmospheric middle distillate $M_1$ is used as feed component for the hydrocracker. If, however, it is the intention to prepare, besides one or more light distillates, also higher boiling atmospheric middle distillate $M_1$ as end-product, fraction $M_1$ is removed from the process as end-product.

In the process according to the invention the catalytic hydrotreatment may be applied to a vacuum residue or to an asphalt obtained therefrom by deasphalting. If the catalytic hydrotreatment is applied to a vacuum residue, an asphalt is separated from the vacuum residue $VR_2$ by deasphalting, at least part of which asphalt is again subjected to the catalytic hydrotreatment. If the catalytic hydrotreatment is applied to an asphalt obtained from a vacuum residue by deasphalting, at least part of the vacuum residue $VR_2$ per se is subjected again to the catalytic hydrotreatment.

If in the further procesing of the vacuum residue $VR_2$ or an asphalt obtained therefrom by deasphalting use is made of a process in which the residue or the asphalt is divided into two portions of the same composition of which one is again subjected to catalytic hydrotreatment, whereas the other portion is removed from the process, the quantity of material which is recirculated is preferably 25–75%w of the available quantity of residue or asphalt.

The catalytic hydrotreatment which in the process according to the invention is applied as supplementary treatment takes place by contacting the feed at elevated temperature and pressure and in the presence of hydrogen to a non-acidic or weakly acidic catalyst. In the catalytic hydrotreatment the following reaction conditions preferably are used: a temperature in the range from about 380° to 500° C and particularly from 400° to 450° C, a hydrogen partial pressure in the range from about 50 to 300 bar and particularly from 75 to 150 bar, a space velocity in the range from about 0.1 to 5 $kg.\mathbf{1}^{-1}.hour^{-1}$ and particularly from 0.2 to 1 $kg.\mathbf{1}^{-1}.hour^{-1}$ and a hydrogen/feed ratio in the range from about 200 to 2000 $\mathbf{N1}.kg^{-1}$ and particularly from 500 to 1500 $\mathbf{N1}.kg^{-1}$. In the catalytic hydrotreatment preferably a temperature is applied which is at least 10° C and more preferably at least 20° C higher than the applied hydrocracking temperature. (If the hydrocracking is carried out in two steps then in this context the hydrocracking temperature should be understood to be the temperature of the second step). Examples of suitable catalysts for carrying out the catalytic hydrotreatment, are alumina, sulfidic catalysts optionally containing fluorine and comprising nickel and/or cobalt and in addition molybdenum, tungsten and/or vanadium on alumina as carrier, and sulfidic catalysts comprising nickel and/or cobalt and in addition molybedenum, tungsten and/or vanadium on silica or silica-alumina as carrier.

In the process according to the invention, finally, deasphalting is used as a supplementary treatment. Thus from a vacuum residue a deasphalted oil is obtained which serves as feed component for the hydrocracker. The deasphalting is preferably carried out at elevated temperature and pressure and in the presence of an excess of a lower hydrocarbon such as propane, butane or pentane as solvent.

Six attractive process schemes for carrying out the process according to the invention will be explained in more detail below with reference to the accompanying figures.

PROCESS SCHEME I (see FIG. I)

The process is carried out in a plant which consecutively comprises a first vacuum distillation unit 1, a deasphalting unit 2, a catalytic hydrotreating unit 3, a first atmospheric distillation unit 4, a second vacuum distillation unit 5, a catalytic hydrocracking unit 6 and a second atmospheric distillation unit 7. An atmospheric distillation residue 8 is split by vacuum distillation into a vacuum distillate 9 and a vacuum residue 10. The vacuum residue is split by deasphalting into a deasphalted oil 11 and an asphalt 12. The asphalt is subjected to a catalytic hydrotreatment and the hydrotreated product 13 is split by atmospheric distillation into a $C_4$− fraction 14, a gasoline fraction 15, a middle distillate fraction 16 and a residue 17. The residue 17 is split by vacuum distillation into a vacuum distillate 18 and a vacuum residue 19. The residue 19 is divided into two portions of the same composition, of which one 20 is again subjected to the catalytic hydrotreatment, whereas the other 21 is removed from the process. Vacuum distillates 9 and 18 are hydrocracked together with the deasphalted oil 11. The cracked product 22 is split by atmospheric distillation into a $C_4$− fraction 23, a gasoline fraction 24, a middle distillate fraction 25 and a residue 26. The residue 26 is again subjected to hydrocracking.

PROCESS SCHEME II (see FIG. I)

The process is carried out in the same plant as described under process scheme I. The processing of the atmospheric distillation residue 8 takes place in substantially the same way as described under process scheme I, the difference being that now the residue 26 is divided into two portions of the same composition, of which one 27 is again subjected to hydrocracking, whereas the other 28 is removed from the process.

PROCESS SCHEME III (see FIG. I)

The process is carried out in the same plant as described under process scheme I. The processing of the atmospheric distillation residue 8 takes place in substantially the same way as described under process scheme II, the difference being that now the middle distillate fraction 16 is used as feed component for the hydrocracking unit and that the middle distillate fraction 25 is again subjected to the hydrocracking.

PROCESS SCHEME IV (see FIG. II)

The process is carried out in a plant which consecutively comprises a first vacuum distillation unit 1, a catalytic hydrotreating unit 2, a first atmospheric distillation unit 3, a second vacuum distillation unit 4, a deasphalting unit 5, a catalytic hydrocracking unit 6 and a second atmospheric distillation unit 7. An atmospheric distillation residue 8 is split by vacuum distillation into a vacuum distillate 9 and a vacuum residue 10. The vacuum residue is subjected to a catalytic hydrotreatment and the hydrotreated product 11 is split by atmospheric distillation into a $C_4$− fraction 12, a gasoline fraction 13, a middle distillate fraction 14 and a residue 15. The residue 15 is split by vacuum distillation into a vacuum distillate 16 and a vacuum residue 17. The vacuum residue 17 is split by deasphalting into a deasphalted oil (18) and an asphalt 19. The asphalt 19 is divided into two portions of the same composition, of which one 20 is again subjected to the catalytic hydrotreatment whereas the other 21 is removed from the process. Vacuum distillates 9 and 16 together with the deasphalted oil 18 are hydrocracked. The cracked product 22 is split by atmospheric distillation into a $C_4$− fraction 23, a gasoline fraction 24, a middle distillate fraction 25 and a residue 26. The residue 26 is divided into two portions of the same composition, of which one 27 is again subjected to hydrocracking, whereas the other 28 is removed from the process.

PROCESS SCHEME V (see FIG. II)

The process is carried out in the same plant as described under process scheme IV. The processing of the atmospheric distillation residue 8 takes place in substantially the same way as described under process sceheme IV, the differences being that now the middle distillate fraction 14 is used to feed component for the hydrocracking section and that the middle distillate fraction 25 is again subjected to hydrocracking.

PROCESS SCHEME VI (see FIG. II)

The process is carried out in a plant which is substantially equal to the one described under process scheme IV, the difference being that now there is a third vacuum distillation unit after the second atmospheric distillation unit 7. The processing of the atmospheric distillation residue 8 takes place in substantially the same way as described under process scheme V, the differences being that now the atmospheric residue 26 is split by vacuum distillation into a vacuum distillate 27 and a vacuum residue 28, that the vacuum distillate 27 is again subjected to hydrocracking and that the vacuum residue 28 is divided into two portions of the same composition, of which one 29 is again subjected to hydrocracking, whereas the other 30 is removed from the process.

The invention is now explained with reference to the following examples.

The process according to the invention was applied to an atmospheric distillation residue of a crude oil originating from the Middle East. The atmospheric distillation residue had an initial boiling point of 370° C, a sulphur content of 4.5 %w and a $C_5$-asphaltenes content of 7.5 %w. The process was carried out according to process schemes I–VI. In the various units the following conditions were applied.

In all the process schemes use was made of a sulphidic $Ni/Mo/Al_2O_3$ catalyst containing 100 parts by weight of alumina, 5 parts by weight of nickel and 10 parts by weight of molybdenum for the catalytic hydrotreatment and this treatment was carried out at a hydrogen partial pressure of 120 bar and a hydrogen/feed ratio of 1000 $N1.kg^{-1}$. When process schemes I, II and III were used the catalytic hydrotreatment took place at an average temperature of 430° C and a space velocity of 0.3 $kg.1^{-1}.hour^{-1}$; when process schemes IV, V and VI were used this treatment was carried out at an average temperature of 440° C and a space velocity of 0.6 $kg.1^{-1}.hour^{-1}$.

In all the process schemes the catalytic hydrocracking was carried out in two steps, the total reaction product from the first step being used as feed for the second step; part of the cracked product was recycled to the first step. In all the process schemes use was made of a sulphidic $Ni/Mo/F/Al_2O_3$ catalyst containing 5 parts by weight of nickel, 20 parts by weight of molybdenum and 15 parts by weight of fluorine per 100 parts by weight of alumina for the first step of the catalytic hydrocracking and of a sulphidic Ni/W/F/faujasite catalyst containing 3 parts by weight of nickel, 10 parts by weight of tungsten and 5 parts by weight of fluorine per 100 parts by weight of faujasite for the second step. In all the process schemes the first step of the catalytic hydrocracking was carried out at a hydrogen partial pressure of 115 bar and a hydrogen/feed ratio of 1000 $N1.kg^{-1}$. When process schemes I, II, III, IV, V and VI were used, in the first step average temperatures of 395°, 380°, 380°, 380°, 390° and 390° C, respectively, and space velocities of 0.8, 1.0, 0.6, 1.0, 0.6 and 0.6 $kg.l^{-1}.hour^{-1}$, respectively, were applied and in the second step average temperatures of 375°, 370°, 370°, 370°, 375° and 375° C, respectively, and space velocities of 0.8, 1.0, 0.6, 1.0, 0.6 and 0.8 $kg.1^{-1}.hour^{-1}$.

In all the process schemes the deasphalting was carried out at 120° C with liquid butane as the solvent and using a solvent/oil weight ration varying between 2.5:1 and 3.5:1.

EXAMPLE I

This example was carried out according to process scheme I. Starting from 100 parts by weight of 370° C+ atmospheric distillation residue (8) the following quantities of the various streams were obtained:

42.0 parts by weight of 370°-520° C vacuum distillate 9,
58.0 parts by weight of 520° C+ vacuum residue 10,
34.0 parts by weight of deasphalted oil 11,
24.0 parts by weight of asphalt 12,
25.8 parts by weight of hydrotreated product 13,
3.1 parts by weight of $C_4$- fraction 14,
1.9 parts by weight of $C_5$-170° C gasoline fraction 15,
9.5 parts by weight of 170°-370° C middle distillate fraction 16,
11.3 parts by weight of 370° C+ atmospheric residue 17,
5.7 parts by weight of 370°-520° C vacuum distillate 18,
b 5.6 parts by weight of 520° C+ vacuum residue 19,
1.4 parts by weight of portion 20,
4.2 parts by weight of portion 21,
93.8 parts by weight of cracked product 22,
4.6 parts by weight of $C_4$- fraction 23,
51.9 parts by weight of $C_5$-170° C gasoline fraction 24,
27.9 parts by weight of 170°-370° C middle distillate fraction 25, and
9.4 parts by weight of 370° C+ atmospheric residue 26.

EXAMPLE II

This example was carried out according to process scheme II. Starting from 100 parts by weight of 370° C+ atmospheric distillation residue 8 the quantities indicated in example I were obtained of streams 9 up to and including 21 and the following quantities of the remaining streams:

88.6 parts by weight of cracked product 22,
4.4 parts by weight of $C_4$- fraction 23,
49.1 parts by weight of $C_5$-170° C gasoline fraction 24,
26.5 parts by weight of 170°-370° C middle distillate fraction 25,
8.6 parts by weight of 370° C+ atmospheric residue 26,
4.3 parts by weight of portion 27 and
4.3 parts by weight of portion 28.

EXAMPLE III

This example was carried out according to process scheme III. Starting from 100 parts by weight of 370° C+ atmospheric distillation residue 8 the quantities indicated in example I were obtained of streams 9 up to and including 21 and the following quantities of the remaining streams:

143.5 parts by weight of cracked product 22,
7.4 parts by weight of $C_4$- fraction 23,
83.7 parts by weight of $C_5$-170° C gasoline fraction 24,
43.8 parts by weight of 170°-370° C middle distillate fraction 25,
8.6 parts by weight of 370° C+ atmospheric residue 26,
4.3 parts by weight of portion 27 and
4.3 parts by weight of portion 28.

EXAMPLE IV

This example was carried out according to process scheme IV. Starting from 100 parts by weight of 370° $C^{30}$ atmospheric distillation residue 8 the following quantities of the various streams were obtained.

42.0 parts by weight of 370°-520° C vacuum distillate 9,
58.8 parts by weight of 520° C+ vacuum residue 10,
59.6 parts by weight of hydrotreated product 11,
7.1 parts by weight of $C_4$- fraction 12,
4.2 parts by weight of $C_5$-170° C gasoline fraction 13,
22.0 parts by weight of 170°-370° C middle distillate fraction 14,
26.2 parts by weight of 370° C+ atmospheric residue 15,
13.1 parts by weight of 370°-520° C vacuum distillate 16,
13.1 parts by weight of 520°C+ vacuum residue 17,
10.5 parts by weight of deasphalted oil 18,
2.6 parts by weight of asphalt 19,
0.7 parts by weight of portion 20,
1.9 parts by weight of portion 21,
71.3 parts by weight of cracked product 22,
3.6 parts by weight of $C_4$- fraction 23,
39.4 parts by weight of $C_5$-170° C gasoline fraction 24,
21.2 parts by weight of 170°-370° C middle distillate fraction 25,
7.1 parts by weight of 370° C+ atmospheric residue 26,
3.6 parts by weight of portion 27, and
3.5 parts by weight of portion 28.

EXAMPLE V

This example was carried out according to process scheme V. Starting from 100 parts by weight of 370° C+ atmospheric distillation residue 8 the quantities indicated in example IV were obtained of streams 9 up to and including 21 and the following quantities of the remaining streams:

139.0 parts by weight of cracked product 22,
6.9 parts by weight of $C_4$- fraction 23,
81.3 parts by weight of $C_5$-170° C gasoline fraction 24,
43.7 parts by weight of 170°-370° C middle distillate fraction 25,
7.1 parts by weight of 370° C+ atmospheric residue 26,
3.6 parts by weight of portion 27, and 3.5 parts by weight of portion 28.

EXAMPLE VI

This example was carried out according to process scheme VI. Starting from 100 parts by weight of 370° C+ atmospheric distillation residue 8 and the quantities indicated in example IV were obtained of streams 9 up to and including 21 and the following quantities of the remaining streams:

143.3 parts by weight of cracked product 22,
7.0 parts by weight of $C_4$− fraction 23,
83.9 parts by weight of $C_5$–170° C gasoline fraction 24,
45.2 parts by weight of 170°–370° C middle distillate fraction 25,
7.2 parts by weight of 370° C+ atmospheric residue 26,
5.4 parts by weight of 370°–520° C vacuum distillate 27,
1.8 parts by weight of 520° C+ vacuum residue 28,
0.9 parts by weight of portion 29, and
0.9 parts by weight of portion 30.

What is claimed is:

1. A process for the production of at least one atmospheric hydrocarbon oil distillate from an atmospheric hydrocarbon oil residue comprising:

a. distilling said atmospheric residue by vacuum distillation in a first vacuum distillation zone to obtain a vacuum distillate, which is passed to step *f*, and a vacuum residue,
b. hydrotreating said vacuum residue in a hydrotreating zone to obtain a hydrotreated product,
c. distilling said hydrotreated product in a first atmospheric distillation zone to obtain at least one light atmospheric distillate, an atmospheric middle distillate and an atmospheric hydrotreated residue,
d. distilling said atmospheric hydrotreated residue in a second vacuum distillation zone to obtain a vacuum hydrotreated distillate and a vacuum hydrotreated residue,
e. recycling at least part of the vacuum hydrotreated residue from step *d* to the hydrotreating zone of step *b*,
f. hydrocracking the vacuum distillates from step *a* and the vacuum hydrotreated distillate from step (d) in a hydrocracking zone, to obtain a hydrocracked product,
g. distilling said hydrocracked product in a second atmospheric distillation zone to obtain at least one light atmospheric hydrocracked hydrocarbon oil distillate and a hydrocracked residue, and
h. recycling at least part of the hydrocracked residue from step *g* to the hydrocracking zone of step *f*.

2. A process as in claim 1 further comprising intermediate to steps *a* and *b* deasphalting the vacuum residue product of step *a* in a deasphalting zone at elevated temperature and pressure in the presence of an excess of a lower hydrocarbon as solvent to obtain a deasphalted oil and an asphalt, and passing the deasphalted oil to the hydrocracking zone of step (f) and passing the asphalt to the hydrotreating zone of step (b).

3. A process as in claim 1 wherein in step (*h*), at lest 25% of the residue is recycled to the hydrocracking zone of step (*f*).

4. A process as in claim 1 wherein step *f* the hydrocracking is carried out as a two-step process using a catalyst selected from the group consisting of weakly acidic and moderately acidic catalyst comprising one or more metals with hydrogenating activities on a carrier in the first step, and a catalyst selected from the group consisting of moderately acidic and strongly acidic catalysts comprising one or more metals with hydrogenating activity on a carrier in the second step.

5. A process as in claim 1, wherein in step *f* in the one-step hydrocracking or in the second step of the two-step hydrocracking the following conditions are used: a temperature of from 250° to 425° C, a hydrogen partial pressure of from 50 to 300 bar, a space velocity of from 0.1 to 10 $kg.1^{-1}$ and a hydrogen/feed ratio of from 200 to 3000 $N1.\ kg^{-1}$.

6. A process as in claim 5 wherein the hydrocracking is carried out in two steps, using the following conditions in the first step: a temperature of from 300° to 450° C, a hydrogen partial pressure of from 50 to 30 bar, a space velocity of from 0.1 to 5 $kg.1^{-1}.\ hour^{-1}$ and a hydrogen/feed ratio of from 200 to 3000 $N1.kg^{-1}$.

7. A process as in claim 1 wherein the catalytic hydrotreatment the following conditions are employed: a temperature of from 380° to 500° C, a hydrogen partial pressure of from 50 to 300 bar, a space velocity of from 0.1 to 5 $kg.1^{-1}.\ hour^{-1}$ and a hydrogen feed ratio of from 200 to 2000 $N1.kg^{-1}$.

8. A process as in claim 1 wherein in step *b* in the catalytic hydrotreatment a temperature is used which is at least 10° C higher than the hydrocracking temperature employed in step (*f*).

* * * * *